US005509215A

United States Patent [19]

Koiranen et al.

[11] Patent Number: 5,509,215

[45] Date of Patent: Apr. 23, 1996

[54] METHOD AND DEVICE FOR STABILIZATION OF A PAPER WEB IN A GROUP OF CYLINDERS IN A DRYING SECTION OF A PAPER MACHINE

[75] Inventors: Vesa Koiranen, Raisio; Vesa Vuorinen; Raimo Virta, both of Turku, all of Finland

[73] Assignee: Valmet Paper Machinery Inc., Helsinki, Finland

[21] Appl. No.: 45,638

[22] Filed: Apr. 9, 1993

[30] Foreign Application Priority Data

Apr. 10, 1992 [FI] Finland ..... 921629

[51] Int. Cl.[6] ..... D06F 58/00

[52] U.S. Cl. ..... 34/117; 34/120

[58] Field of Search ..... 34/114, 115, 116, 34/117, 120, 122, 123

[56] References Cited

U.S. PATENT DOCUMENTS

| | | | |
|---|---|---|---|
| 4,509,274 | 4/1985 | Heimel et al. | 34/116 |
| 4,516,330 | 5/1985 | Eskelinen et al. | 34/23 |
| 4,628,618 | 12/1986 | Virta et al. | 34/116 |
| 4,905,380 | 3/1990 | Eskelinen et al. | 34/23 |
| 4,967,489 | 11/1990 | Autio | 34/115 |
| 5,044,094 | 9/1991 | Ilvespaa et al. | 34/114 |
| 5,068,980 | 12/1991 | Müller | 34/116 |

FOREIGN PATENT DOCUMENTS

| | | |
|---|---|---|
| 0415900 | 3/1991 | European Pat. Off. . |
| 3538623 | 5/1986 | Germany . |
| 3818600 | 12/1988 | Germany . |
| 3828743 | 3/1989 | Germany . |
| 8706283 | 10/1987 | WIPO . |
| 8901073 | 2/1989 | WIPO . |

*Primary Examiner*—Denise L. Gromada
*Assistant Examiner*—Susanne C. Tinker
*Attorney, Agent, or Firm*—Steinberg, Raskin & Davidson

[57] ABSTRACT

The invention relates to a method and device for stabilizing a paper web in a group of cylinders in the dryer section of a paper machine. The group of cylinders are arranged in a row of drying cylinders and a corresponding row of leading rolls or equivalent placed as interlocked with the drying cylinders. The group of cylinders is provided with a single-wire draw so that the heated drying cylinders in the group are placed outside the loop of the drying wire and the leading rolls in the group are placed inside the loop of the drying wire. The stabilization device is arranged in the area between adjacent drying cylinders and the leading roll or equivalent placed as interlocked between the adjacent drying cylinders in the group of cylinders. Air is blow from the device and directed in the direction opposite to the running direction of the paper web. A nozzle opening of the stabilization device is shaped so that the air flow follows a substantially smooth face of the stabilization device while, at the same time, ejecting surrounding air along with it. In preferred embodiments, the smooth face is substantially parallel to the drying wire and the group of cylinders is formed as a compact geometry.

30 Claims, 3 Drawing Sheets

METHOD AND DEVICE FOR STABILIZATION OF A PAPER WEB IN A GROUP OF CYLINDERS IN A DRYING SECTION OF A PAPER MACHINE

BACKGROUND OF THE INVENTION

The invention relates to a method and device for stabilizing a paper web in a group of cylinders in a dryer section of a paper machine. The group of cylinders comprises a row of heated drying cylinders and a corresponding row of leading rolls or equivalent placed in interposed interlocking relationship with the drying cylinders. The heated drying cylinders in the group are placed outside a loop of a drying wire whereas the leading rolls in the group are placed inside the loop of the drying wire such that a single-wire draw is defined between the leading rolls and the drying cylinders. A stabilization device is provided in the area between adjacent drying cylinders and one of the leading rolls or equivalent which is placed in proximity to, and in an interlocking relationship with, the adjacent drying cylinders in the group of cylinders. The interlocking relationship provides that the drying wire runs from a first one of the adjacent drying cylinders to the leading roll and then to the second one of the adjacent drying cylinders. An air flow is directed from the stabilization device in a direction opposite to the running direction of the paper web.

Prior art dryer sections in paper machines comprise a number of drying cylinders, which are usually heated by steam. The paper web or board to be dried is pressed against the drying cylinders by means of the drying wire into contact with a heated face of the drying cylinders. In the dryer sections of prior art devices, both a twin-wire draw and a single-wire draw of the drying wire are employed. Recently, the single-wire draw has become more common because it allows the web to be dried with constant support such that there is a closed draw throughout the entire dryer section and the web does not have any free draws.

Generally, dryer sections with a single-wire draw and two rows of cylinders are used. In these dryer sections, the cylinders in an upper row are heated cylinders and are placed outside the loop of the drying wire. The cylinders in a lower row are leading cylinders or rolls which are provided with suction holes for promoting the support contact between the web and the wire. This result is desirable because the web is running on an outer surface of the drying wire over the leading rolls.

When a number of the above cylinder groups with a single-wire draw are employed and arranged one after the other, it is a significant drawback that the web is dried unevenly, i.e. more quickly at the side that is placed in direct contact with the heated cylinder face. This causes an asymmetric drying of the web.

Asymmetric drying of the web produces a number of drawbacks. For this reason, in recent years multi-cylinder dryer sections having a single-wire draw have become more common in which so-called inverted cylinder groups are used. In an inverted group, the drying cylinders are placed in the lower row and the leading cylinders or rolls in the upper row.

However, in these inverted groups, a significant drawback results from the pumping action caused by the wires because the pumping of air produces detrimental pressure on the free portion at the inlet side of the wire and in the closing wire nips. In the wedge spaces that form the inlet-side nip for the web and for the wire, a pressure tends to be induced.

Corresponding opening nips produce detrimental negative pressure because replacement air is sucked into the nips from the sides of the dryer section. The in-flowing air attempts to penetrate between the wire and the paper thus separating the edge of the paper from the wire. This effect causes several drawbacks, such as web breaks.

Moreover, in an inverted group, the negative pressure in the outlet nips is increased further by the so-called chimney effect, i.e. by the air flows that can rise unhindered out of the spaces upwards by the effect of gravity.

It is also known in prior art devices, in particular in multi-cylinder dryers having a single-wire draw, to place the drying cylinders and the leading rolls very close to one another so that a more compact and less expansive paper-machine dryer section with a single-wire draw is obtained. In this regard, the dryer section can be made both shorter in the machine direction and lower in the vertical direction as compared with other prior art devices. By means of this arrangement, economies are also obtained in the cost of the paper-machine hall. However, in such groups of compact geometry in dryers of paper machines, problems are caused by winding of the paper onto cylinders and rolls. Consequently, the distance between the drying cylinder and the leading roll must be sufficient for the passage of loose paper and in particular for the passage of paper clods. Such a safety distance is commonly about 50 mm to about 100 mm.

In addition, in prior art device such as those described above, the distance between the blow-boxes, stabilization tubes, and equivalent used in the dryer section and the drying cylinder/leading roll must, for the same reasons explained above, be sufficient to pass loose paper and paper clods thereby avoiding unnecessary interruptions. The blow-boxes, stabilization tubes, and equivalent, are supposed to prevent effects detrimental to the support contact between the web and the drying wire.

The phenomena that interferes with the support contact between the web and the drying wire arises, for example, from the fact that boundary-layer flows produce pressure differences between the different sides of the drying wire. These problems and the solutions related to them have been discussed, for example, in Finnish Patent Nos. 65,460 and 69,332.

OBJECTS AND SUMMARY OF THE INVENTION

An object of the present invention is to provide a stabilization device such as a tube for use in the dryer section of a paper machine. The stabilization device is suitable for use in connection with a single-wire draw and in particular in dryer groups with compact geometry.

It is a further object of the present invention to provide a stabilization tube that is particularly well suitable for use in a so-called inverted group.

It is another object of the present invention to provide a new and improved method and device in which the drawbacks relating to the prior art devices are eliminated.

It is yet another object of the present invention to provide a method and device to stabilize a web in a drying section of a paper machine in order to obtain a substantially symmetrically drying of the web.

In view of achieving the objects stated above and others, in the stabilization device in accordance with the invention, a nozzle opening of the device for stabilization is shaped so that an air flow follows a substantially smooth surface of the stabilization device and simultaneously ejects surrounding air along with it. The smooth surface is arranged to be substantially parallel to the drying wire and the drying cylinder over which the drying wire runs. The group of cylinders is formed as a compact geometry and can be used as a separate grouping in any location and in any number of drying sections in paper machines.

An important feature of the present invention is based on the principle that the pressure produced by the pumping performed by the drying wire in the nip is brought to such a level that the paper web adheres to the drying wire and does not separate from the drying wire. Thus, in the method and device in accordance with the invention, the change in the pressure level is produced so that its effect is adequate also across the safety distance. In other words, the distance between the drying cylinders and the leading roll as well as the distance between the stabilization tube and the drying cylinder and leading roll preferably should can be kept sufficiently large such that loose paper and paper clods are removed from the area between the leading roll and drying cylinders.

In one embodiment, the device in accordance with the invention comprises a blow nozzle and body having a substantially smooth surface which preferably conforms with the shape of the drying cylinder preceding the closing nip. The blow direction of the blow nozzle is opposite to the running direction of the drying wire, and the nozzle is shaped so that the air that is blown from the nozzle starts following the smooth surface while, at the same time, causes surrounding air to be ejected along with it out of the area between the drying cylinders and the leading roll. The passage formed by the drying cylinder and the smooth surface of the stabilization tube improves the result further. This passage is made as long as possible so that the effect of the stabilization can be extended over a sufficiently long distance to prevent build-up of paper clods and loose paper.

In a preferred embodiment, a similar passage is arranged at an opposite side of the stabilization tube. Since, at the opposite side, the web runs away from the roll nip, i.e. the opening nip, the pumping produced by the drying wire produces a negative pressure in this passage. This negative pressure is increased further by the air stream flowing out of the blow nozzle.

In another embodiment, the device in accordance with the invention may also be installed closer to the wire. In this embodiment, the device operates as described above, but the nozzle blowing of the stabilization device is placed closer to the wire.

In order to improve the results further, a sealing between the stabilization tube and the leading roll, which is most preferably a suction roll, can be arranged, e.g., by means of an air nozzle or a mechanical seal. If the above modes of operation cannot be employed, it is possible to reduce the air leakage by means of various so-called labyrinth seals while keeping the distance between the pipe and the roll at a standard distance. A basic principle of the present invention, regardless of which means are used, is to make the air follow a solid curved surface and, thereupon, to collide against a sealing element which constitutes an obstacle to the air flow. A better result is achieved if more obstacles are utilized. However, an optimal length is achieved with one pair of obstacles. With a sealing arrangement such as that described above in a device in accordance with the invention, the capacity (negative pressure) can be increased by about 15%.

When the device of the present invention is installed closer to the drying wire, it can also be constructed so that the entire area between the drying cylinder and the roll is closed and the blowing opposite to the wire is produced in the manner described above, either by making use of the passage effect or not using this effect. The negative pressure in the closed space can be increased by means of a blow nozzle arranged parallel to the running direction of the wire and placed between the drying wire and a device arranged at the opposite side or, more commonly, by making use of the pumping effect produced by the wire.

The present invention also relates to an arrangement for stabilizing a paper web or board in a group of cylinders in a dryer section of a paper machine. In the arrangement, a leading roll is arranged between a pair of drying cylinders in the dryer section. The paper web or board runs through the dryer section on a drying wire which runs over the first and second drying cylinders and the leading roll. The stabilization device in accordance with the invention is arranged in an area between the first and second drying cylinders and the leading roll. An air flow is directed from a nozzle opening in the device in a direction opposite to a running direction of the web.

The present invention further relates to a method for stabilizing a paper web in a group of cylinders in a dryer section of a paper machine. In the method in accordance with the invention, a pair of drying cylinder are arranged in the dryer section, and a leading roll is arranged therebetween. A smooth surface of a stabilization device is arranged substantially parallel to a drying wire on which the web is carried through the dryer section. An air flow is directed from a nozzle opening in the stabilization device in a direction opposite to a running direction of the web to cause the air flow to follow the smooth surface and draw surrounding air from the area between the first drying cylinder, the second drying cylinder and the leading roll.

BRIEF DESCRIPTION OF THE DRAWINGS

The following drawings are illustrative of embodiments of the invention and are not meant to limit the scope of the invention as encompassed by the claims.

DETAILED DESCRIPTION OF THE INVENTION

Figures 1, 1A:
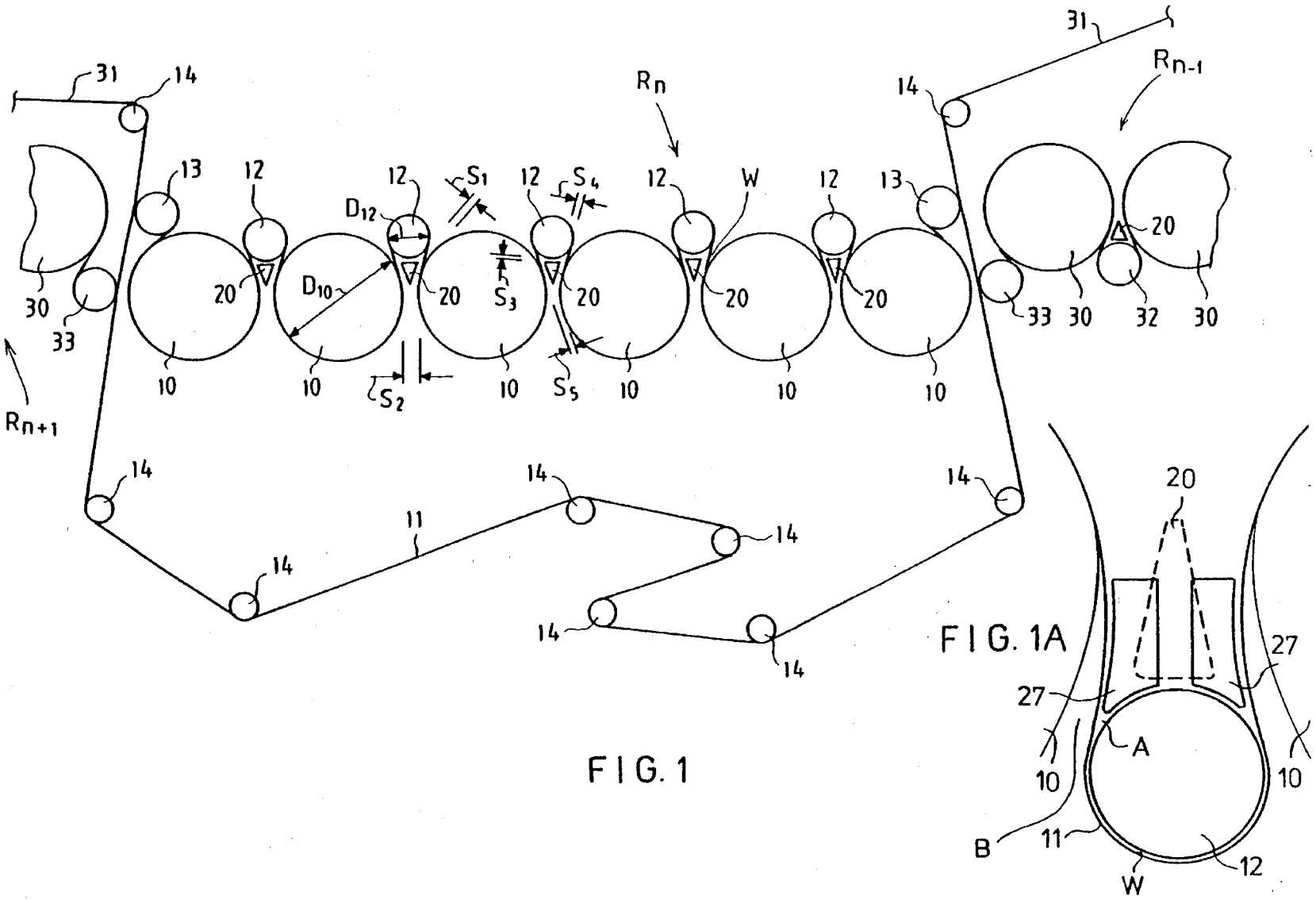
FIG. 1 is a schematic side view of a group of cylinders in the dryer section of a paper machine in which a stabilization device and method in accordance with the present invention are applied.
FIG. 1A is a schematic vertical sectional view which shows the lateral plates employed in connection with the stabilization device and method of the present invention.

FIG. 1 illustrates an inverted cylinder group $R_n$ in a dryer section of a paper machine. In the group $R_n$, a paper web W to be dried enters in direct contact with heated drying cylinders 10 which are arranged in a lower row in the dryer section. Leading rolls or cylinders 12 are arranged in an upper row. In inverted groups $R_n$, a single-wire draw is employed so that a drying wire 11 which is guided by guide rolls 14, carries the web W to be dried meandering over the drying cylinders 10 and the leading rolls 12. The web W is brought into the group $R_n$ from a preceding group $R_{n-1}$, which has a single-wire draw and drying cylinders 30 arranged in the upper row and leading rolls 32 arranged in the lower row. The web W is transferred after a guide roll 33 from a drying wire 31 onto the wire 11 over a guide roll 13 in drying group $R_n$. After the inverted group $R_n$, the web W is transferred after the guide roll 13 into a subsequent non-inverted group $R_{n+1}$ having a single-wire draw, onto a drying wire 31 in group $R_{n+1}$.

The cylinders 10,30 in the dryer section are, for example, steam-heated, smooth-faced drying cylinders, against which the web W to be dried is pressed into direct contact by the drying wire 11,31. The leading rolls 12,32 are, for example, suction cylinders in themselves known in the art, which are provided with a perforated mantle having a grooved outer face. By means of the negative pressure effective in the grooved face of the leading roll 12,32, the web W is reliably kept on the face of the drying wire 11,31 as the web runs over the leading roll 12,32 at the side of the outside curve over a sector larger than 180°. The leading rolls 12,32 may also be smooth, grooved, or perforated rolls.

The stabilization tubes 20,(40,50) shown in FIG. 1 close the inlet nips between the leading roll 12,32 and the drying cylinders 10. The inlet nips are closed in the running direction of the web W. The tubes direct an air flow which causes air to be ejected out of the inlet nips so that a pressure which will interfere with the support contact between the web W and the drying wire 11 is not formed in the inlet nips. This promotes adherence of the web to the drying wire.

FIG. 1 illustrates a group in a paper-machine dryer section in which a so-called compact geometry is applied. In this group, the diameter $D_{10}$ of the drying cylinder 10 is from about 1200 mm to about 2500 mm, preferably from about 1500 mm to about 2500 mm, and the diameter of the leading roll 12 is from about 200 mm to about 2000 mm, preferably from about 500 mm to about 1500 mm. Thus, the ratio of the diameter $D_{12}$ of the leading roll 12 to the diameter $D_{10}$ of the drying cylinder 10 is from about 1:6 to about 4:5, preferably from about 1:3 to about 3:5. The minimum distance $S_1$ between the leading roll 12 and the drying cylinder 10 is from about 50 mm to about 600 mm, preferably from about 75 mm to about 300 mm. The minimum distance $S_2$ between two drying cylinders 10 is from about 100 mm to about 600 mm, preferably from about 150 mm to about 500 mm. The minimum distance $S_3$ of the stabilization tube 20 from the leading roll 12 is from about 0 mm to about 50 mm, preferably from about 10 mm to about 30 mm. The distance $S_4$ of the stabilization tube 20 from the drying cylinder 10 at the inlet side is from about 10 mm to about 100 mm, preferably from about 15 mm to about 75 mm, and the distance $S_5$ from the drying cylinder at the outlet side is from about 10 mm to about 100 mm, preferably from about 20 mm to about 80 mm.

FIG. 1A is a schematic vertical sectional view which shows lateral plates 27 employed in connection with the stabilization device 20 in accordance with the invention. Leakage flow of air which occurs from both edges of the wire 11 can be reduced or prevented so that the space that remains between the leading roll 12 and the adjacent drying cylinders 10 and the wire 11 is closed by means of the lateral plates 27. Lateral plates 27 are constructed of, for example, a suitable plastic which does not damage the wire 11 or the web W even if contact took place. Further, if necessary, the lateral plates 27 are slightly rounded at their edges to prevent any detrimental effects of contact that may take place with the wire 11 and/or the web W.

The lateral plates 27 are preferably used in connection with the device of the invention in the direction of the width of the paper web W to close the space defined by the cylinders 10 and by the leading roll 12. The paper web W forms a closed space defined between the stabilization device/tube 20, the drying cylinders 10, the leading roll 12, and the drying wire 11. In this closed space, the desired pressure level can be produced by means of a nozzle blowing and/or by pumping achieved by the drying wire. In FIG. 1A, a closing wire nip is denoted with reference A, and a corresponding opening nip with reference B.

According to FIGS. 1 and 1A, in the space between the leading rolls and the adjacent drying cylinders 10, stabilization tubes 20,(40,50) in accordance with the invention have been provided, whose construction and operation will be described in more detail with reference to the exemplifying embodiments shown in FIGS. 2 to 5.

Figure 3:
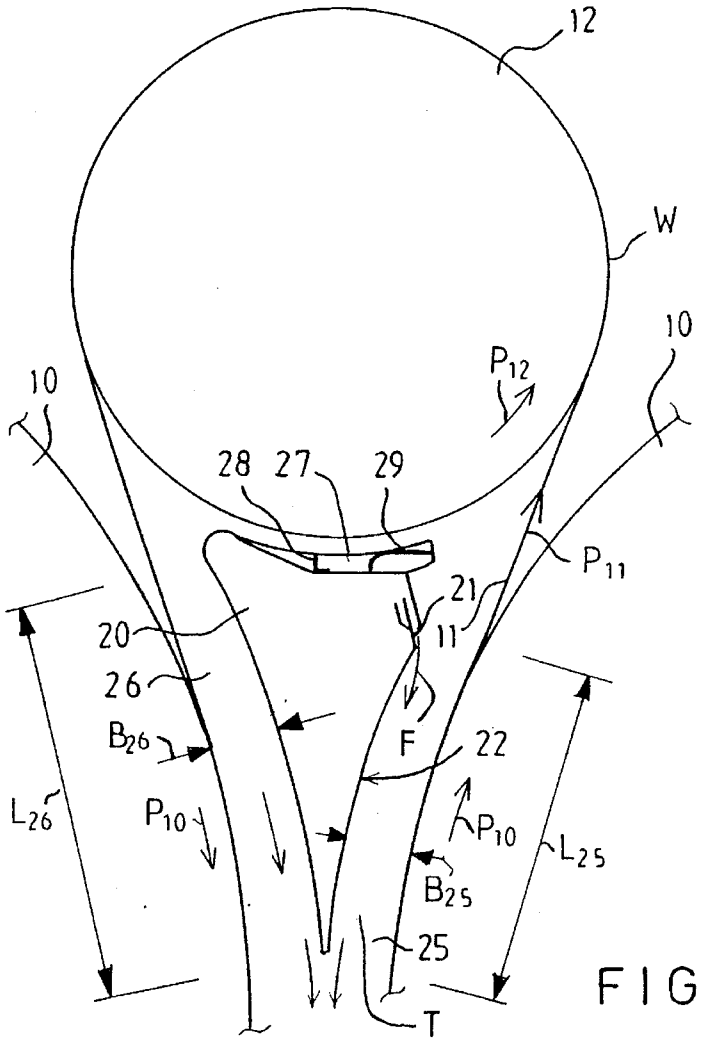
FIG. 3 shows another exemplifying embodiment of the invention in a manner corresponding to FIG. 2.
Figure 2:
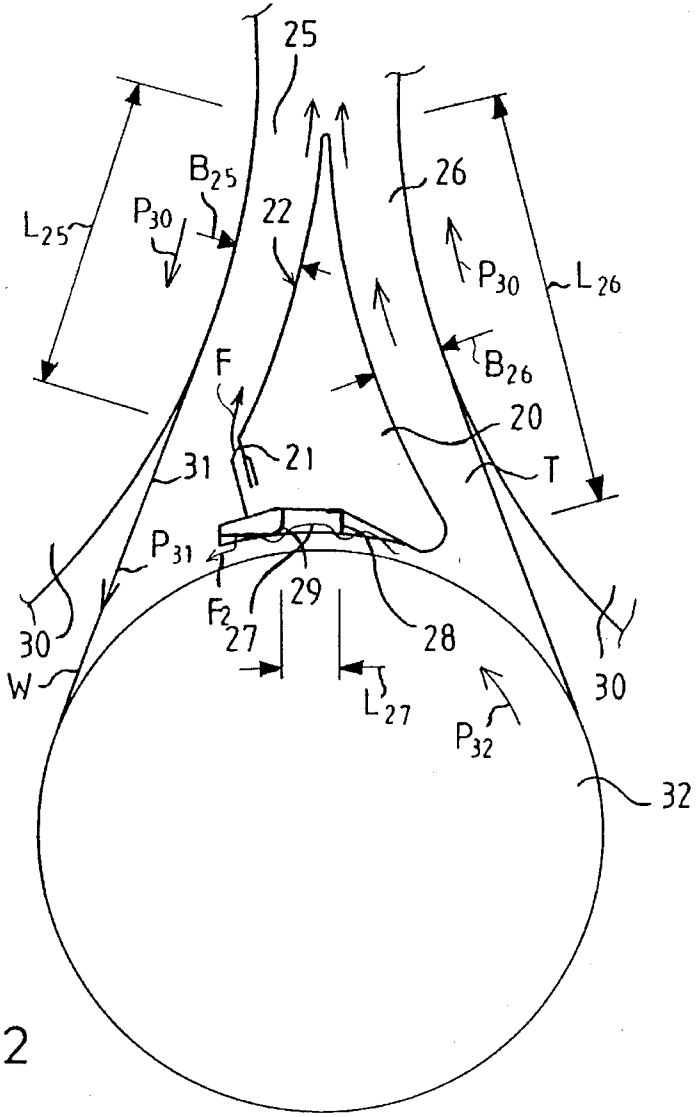
FIG. 2 is a schematic vertical sectional view in the machine direction of an exemplifying embodiment of the stabilization device of the invention used in a method in accordance with the invention.

FIG. 2 illustrates an exemplifying embodiment of the present invention utilized in a "normal" group $R_{n-1}$,$R_{n+1}$ in a dryer section. FIG. 3 illustrates another exemplifying embodiment utilizing an inverted group $R_n$ in a dryer section. In FIGS. 2 and 3, the direction of rotation of the leading roll 12,32 is denoted with arrow $P_{12}$ and $P_{32}$, respectively, and the direction of rotation of the drying cylinders 10,30 is denoted with arrow $P_{10}$ and $P_{30}$, respectively. The running direction of the drying wire 11,31, and thus also of the web W, is denoted with arrow $P_{11}$ and $P_{31}$, respectively.

The stabilization tube 20 illustrated in FIGS. 2 and 3 has a box-shaped body and extends in the transverse direction across the entire width of the paper web W. With regard to its cross-sectional shape, the stabilization tube 20 is triangular and conforms to the shape of an area T defined between the drying cylinders 10 and the leading roll 12.

The stabilization tube 20 is connected to an air pipe (not shown) through which dry air at a suitable temperature is introduced into the stabilization tube 20. The dry air is blown out of an opening 21 in the stabilization tube 20 as an air flow F in the direction opposite to the running direction of the adjacent web W. The nozzle opening 21 has a diameter from about 0.5 mm to about 5 mm, preferably from about 1 mm to about 3 mm, and is shaped so that the air flow F follows a smooth surface 22 of the stabilization tube 20 while simultaneously ejecting surrounding air along with it. The shape of the smooth surface 22 of the stabilization tube 20 complies with the shape of the adjacent drying cylinder 10 and of the drying wire 11, i.e. the curve form, and is substantially parallel to the faces of the drying wire 11 and drying cylinder 10 and further extends across substantially the entire width of the web. In this manner, a passage 25 is formed between the smooth surface 22 of the stabilization tube 20 and the adjacent drying cylinder 10 and drying wire 11. The passage 25 formed by the drying cylinder 10,30 and by the smooth surface 22 of the stabilization tube 20 improves the stabilization results obtained in the present invention.

The width $B_{25}$ of the passage 25 is from about 10 mm to about 100 mm, preferably from about 20 mm to about 80 mm. In view of obtaining the best stabilization result, the passage 25 is formed as long as possible, and its length $L_{25}$ is from about 100 mm to about 600 mm, preferably from about 200 mm to about 500 mm. Also, at the opposite side of the stabilization tube 20, there may be a passage 26 of corresponding type, whose length $L_{26}$ is from about 50 mm to about 600 mm, preferably from about 100 mm to about 500 mm, and width $B_{26}$ is from about 5 mm to about 100 mm, preferably from about 20 mm to about 80 mm. At this opposite side, the drying wire 11,31 and the web W run away from the roll nip in which case the pumping effect produced by the drying wire 11,31 produces a negative pressure in the passage 26. The air flow F also increases the negative pressure in the opposite opening nip, i.e. in the outlet nip.

The sealing between the stabilization tube 20 and the leading roll 12,32 can be achieved, e.g., by means of an air nozzle or a mechanical seal (not shown). Air leakage can also be reduced by means of a so-called labyrinth seal in which case the distance between the stabilization tube 20 and the leading roll 12 can be kept within typical and normal ranges, from about 15 mm to about 20 mm. The principle of a labyrinth seal construction 27 is to make the air flow $F_L$ follow a fixed curved face and to collide against an obstacle 28,29 while it is following the curved face. The more obstacles 28,29 can be prepared, the better is the result that is obtained. However, it is necessary to consider the optimal length $L_{27}$ of one pair of obstacles 28,29 which is from about 50 mm to about 300 mm, preferably from about 100 mm to about 200 mm. In this manner, the sealing is improved by about 15% when compared with an embodiment in which a labyrinth-seal construction 27 is not used.

Figure 4:
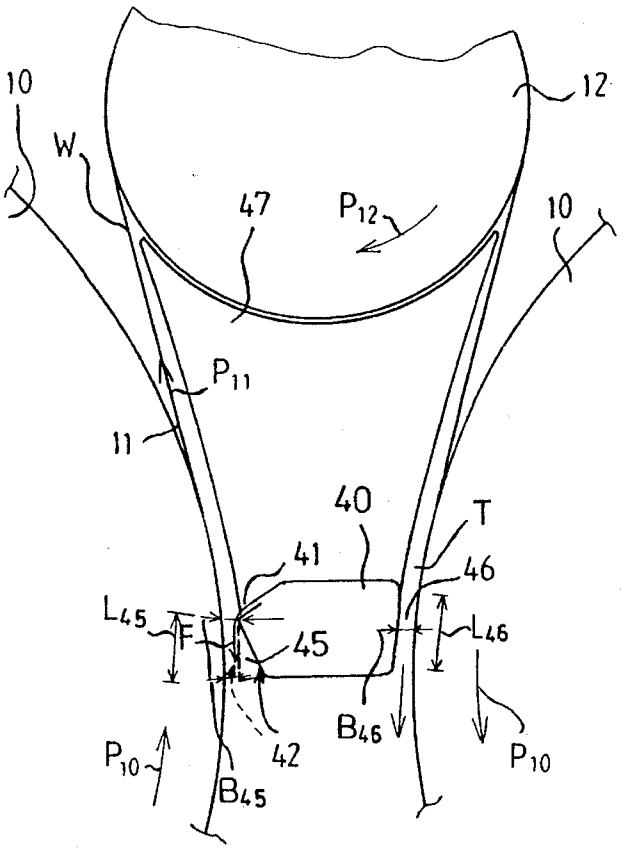
FIG. 4 shows a further exemplifying embodiment of the invention in a manner corresponding to FIGS. 2 and 3.

The embodiment of the invention as shown in FIG. 4 operates in principle in the manner of the present invention as illustrated and described above with references to the embodiments of FIGS. 2 and 3, and the same reference numerals have been used for equivalent parts. The stabilization device 40 has a box construction which extends substantially across the entire width of the web W at its edges and is installed in proximity to the drying wire 11. The air flow F flowing from a nozzle opening 41 of the stabilization tube/device 40 starts to follow a smooth face 42 of the stabilization device 40. The distance $B_{45}$ between the wire 11 and the stabilization device 40 in a passage 45 at the level of the nozzle opening 41 is from about 10 mm to about 50 mm, preferably from about 15 mm to about 25 mm. In a passage 46 at an opposite side of the nozzle opening 41, the distance $B_{46}$ between the stabilization box 40 and the wire 11 is from about 5 mm to about 50 mm, preferably from about 10 mm to about 30 mm. The length $L_{45}$ of the passage 45 is from about 50 mm to about 300 mm, preferably from about 100 mm to about 200 mm.

In the embodiment of the present invention illustrated in FIG. 4, the area between the drying cylinders 10 is closed by means of the stabilization tube 40. In the direction of width of the paper web W, the space defined by the cylinders 10 and by the leading roll 12 is closed at its ends by means of lateral plates 47. The stabilization tube 40, the drying cylinders 10, the leading roll 12, and the paper web W which runs on the drying wire 11 form a closed space therebetween in which a desired pressure level can be produced by means of nozzle blowing and/or pumping by the wire. In FIG. 4, the solid line illustrates an embodiment in which a passage is not formed between the drying cylinder 10 and the stabilization tube 40 at the side of the nozzle opening 41, whereas the dashed line shows an embodiment having a passage 45. The passage formed between the opposite side of the stabilization device/tube 40 and the adjacent drying wire 11 on the drying cylinder 10 is denoted with the reference numeral 46.

Figure 5:
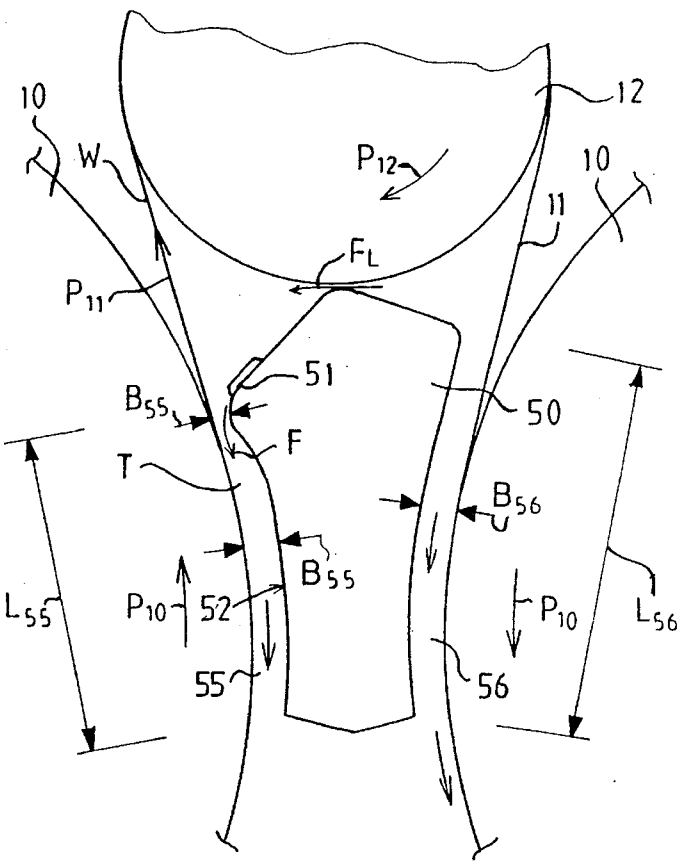
FIG. 5 shows a further exemplifying embodiment of the invention in a manner corresponding to FIGS. 2 and 3.

In the exemplifying embodiment of the invention shown in FIG. 5, the elements are similar to those illustrated in FIGS. 2–4 and the same reference numerals have been used for equivalent parts. In FIG. 5, the stabilization tube 50 is also arranged in proximity to the wire 11, and the distance $S_{55}$ between a nozzle opening 51 of the stabilization tube 50 and the drying wire is from about 10 mm to about 50 mm. The stabilization device 50 operates in the manner described above in relation to FIGS. 2–4. However, in the embodiment of FIG. 5, the nozzle blowing and the air flow F have been arranged closer to the wire 11. The stabilization device 50 has a box construction and extends across the entire width of the web W. The length $L_{55}$ of a passage 55 between the stabilization box 50 and the paper web W running on the drying wire 11 is from about 50 . . . 500 mm, preferably from about 150 mm to about 400 mm, and the width $B_{55}$ is from about 30 mm to about 100 mm, preferably from about 50 mm to about 75 mm.

The examples provided above are not meant to be exclusive. Many other variations of the present invention would be obvious to those skilled in the art, and are contemplated to be within the scope of the appended claims.

We claim:

1. A device for stabilizing a paper web in a group of cylinders in a dryer section of a paper machine, said group of cylinders including a row of drying cylinders having at least one pair of adjacent drying cylinders, and a corresponding row of at least one leading roll, each leading roll interposed between said drying cylinders of a pair of adjacent drying cylinders, and a looped drying wire for carrying the web running between said cylinders and rolls with said drying cylinders situated outside said loop and said at least one leading roll situated within said loop, said stabilizing device comprising:

a body situated in a space between a pair of adjacent drying cylinders and a leading roll interposed between them, said body having a substantially smooth surface shaped and positioned in opposed relationship to a segment of one of said pair of adjacent drying cylinders over which said drying wire runs, said smooth surface extending substantially parallel to said drying cylinder segment; and nozzle means provided on said body for directing an air flow over said smooth surface to follow the shape thereof in a direction opposite to a running direction of said drying wire to eject air surrounding said air flow.

2. The device of claim 1, wherein the minimum distance between said pair of drying cylinders is from about 150 mm to about 500 mm, and the minimum distance between said pair of drying cylinders and said leading roll interposed between them is from about 75 mm to about 300 mm.

3. The device of claim 1, wherein the ratio of the diameter of said leading roll to the diameter of each of said pair of adjacent drying cylinders is from about 1:6 to about 4:5.

4. The device of claim 3, wherein the ratio of the diameter of said leading roll to the diameter of each of said pair of adjacent drying cylinders is from about 1:3 to about 3:5.

5. The device of claim 1, wherein said smooth surface of said stabilization device and said drying cylinder segment define a passage therebetween, and said air flow is directed through said passage.

6. The device of claim 5, wherein the length of said passage is from about 50 mm to about 500 mm, and the width of said passage is from about 10 mm to about 100 mm.

7. The device of claim 6, wherein the length of said passage is from about 100 mm to about 400 mm, and the width of said passage is from about 15 mm to about 75 mm.

8. The device of claim 1, further comprising sealing means to seal a gap formed between said leading roll and said stabilization device.

9. The device of claim 8, wherein said sealing means comprise a labyrinth seal having at least one pair of sealing elements.

10. The device of claim 9, wherein the length of said pair of sealing elements is from about 50 mm to about 300 mm.

11. The device of claim 10, wherein the length of said pair of sealing elements is from about 100 mm to about 200 mm.

12. The device of claim 1, wherein said stabilization device has a cross-sectional shape corresponding to the shape of said space between said pair of adjacent drying cylinders and the leading roll interposed between them.

13. The device of claim 1, wherein said pair of adjacent drying cylinders and said leading roll interposed between them are arranged as a compact geometry.

14. A method for stabilizing a paper web in a group of cylinders in a dryer section of a paper machine, comprising the steps of:

arranging a first and second drying cylinder in the dryer section at a minimum distance from each other of about 100 mm to about 600 mm, arranging a leading roll with the minimum distance between each of said first and second drying cylinders and said leading roll being from about 50 mm to about 600 mm, said leading roll being arranged inside a loop of a drying wire on which the paper web or board runs through the dryer section, arranging a stabilization device in an area between said first and second drying cylinders and said leading roll, providing said stabilization device with a smooth surface in opposed relationship to a segment of said first drying cylinder, said smooth surface extending substantially parallel to said first drying cylinder segment, and directing an air flow from a nozzle opening in said stabilization device in a direction opposite to a running direction of the web to cause the air flow to follow the smooth surface and draw surrounding air from the area between said first drying cylinder, said second drying cylinder and said leading roll.

15. The method of claim 14, comprising the further step of forming a passage between the first and second drying cylinders and the smooth surface such that the air flow flows through said passage.

16. The method of claim 14, comprising the further step of arranging sealing means in a transverse direction of said stabilization device to increase a negative pressure prevailing in an area between the leading roll and said stabilization device and to cause the web to adhere to the drying wire in single-wire draws of the drying wire between said leading roll and said first and second drying cylinders.

17. The method of claim 14, further comprising conforming the shape of the smooth surface which the air flow follows to the shape of the curve of the drying wire and first drying cylinder.

18. A device for stabilizing a paper web in a group of cylinders in a dryer section of a paper machine, said group of cylinders including a row of drying cylinders having at least one pair of adjacent drying cylinders, and a corresponding row of at least one leading roll, each leading roll interposed between said drying cylinders of a pair of adjacent drying cylinders, and a looped drying wire for carrying the web running between said cylinders and rolls with said drying cylinders situated outside said loop and said at least one leading roll situated within said loop, said stabilizing device comprising:

a body situated in a space between a pair of adjacent drying cylinders and a leading roll interposed between them, the ratio of the diameter of said leading roll to the diameter of each of said pair of adjacent drying cylinders being from about 1:6 to about 4:5, said body having a substantially smooth surface shaped and positioned in opposed relationship to a segment of one of said pair of adjacent drying cylinders over which said drying wire runs, said smooth surface extending substantially parallel to said drying cylinder segment; and nozzle means provided on said body for directing an air flow over said smooth surface to follow the shape thereof in a direction opposite to a running direction of said drying wire to eject air surrounding said air flow.

19. A device for stabilizing a paper web in a group of cylinders in a dryer section of a paper machine, said group of cylinders including a row of drying cylinders having at least one pair of adjacent drying cylinders, and a corresponding row of at least one leading roll, each leading roll interposed between said drying cylinders of a pair of adjacent drying cylinders, and a looped drying wire for carrying the web running between said cylinders and rolls with said drying cylinders situated outside said loop and said at least one leading roll situated within said loop, said stabilizing device comprising:

a body situated in a space between a pair of adjacent drying cylinders and a leading roll interposed between them, said body having a substantially smooth surface shaped and positioned in opposed relationship to a segment of one of said pair of adjacent drying cylinders over which said drying wire runs, said smooth surface extending substantially parallel to said drying cylinder segment; said smooth surface of said stabilization device and said opposed drying cylinder segment defining a passage therebetween, the length of said passage being from about 50 mm to about 500 mm, and the width of said passage being from about 10 mm to about 100 mm; and nozzle means provided on said body for directing an air flow through said passage over said smooth surface to follow the shape thereof in a direction opposite to a running direction of said drying wire to eject air surrounding said air flow.

20. A device for stabilizing a paper web in a group of cylinders in a dryer section of a paper machine, said group of cylinders including a row of drying cylinders having at least one pair of adjacent drying cylinders, and a corresponding row of at least one leading roll, each leading roll interposed between said drying cylinders of a pair of adjacent drying cylinders, and a looped drying wire for carrying the web running between said cylinders and rolls with said drying cylinders situated outside said loop and said at least one leading roll situated within said loop, said stabilizing device comprising:

a body situated in a space between a pair of adjacent drying cylinders and a leading roll interposed between them, said body having a substantially smooth surface shaped and positioned in opposed relationship to a run of said drying wire; said body also having a surface in opposed relationship to said leading roll to define a gap between said body and said leading roll, nozzle means provided on said body for directing an air flow over said smooth surface to follow the shape thereof in a direction opposite to a running direction of said drying wire to eject air surrounding said air flow; and labyrinth sealing means for sealing said gap formed between said leading roll and said body, said sealing means comprising at least one flow obstacle element arranged on said surface of said body opposed to said leading roll such that an air flow over said curved face impacts against said at least one flow obstacle element.

21. The device of claim 1, wherein the minimum distance between said pair of adjacent drying cylinders being from about 100 mm to about 600 mm, and the minimum distance between each of said pair of adjacent drying cylinders and said leading roll interposed between them being from about 50 mm to about 600 mm.

22. The device of claim 1, wherein said smooth surface of said body is curved inward such that said smooth surface conforms to the shape of said drying cylinder segment.

23. The device of claim 1, wherein said nozzle means comprise a single nozzle arranged proximate an end of said smooth surface of said body.

24. The device of claim 1, wherein said body extends in a transverse direction across substantially the entire width of the paper web.

25. The device of claim 1, wherein said body further comprises an additional surface shaped and positioned in opposed relationship to a segment of the other one of said pair of adjacent drying cylinders over which said drying wire runs, said additional surface extending substantially parallel thereto.

26. The device of claim 1, wherein said smooth surface extends across substantially the entire width of the web carried on said drying wire.

27. The method of claim 14, wherein said smooth surface extends across substantially the entire width of the web carried on said drying wire.

28. The device of claim 18, wherein said smooth surface extends across substantially the entire width of the web carried on said drying wire.

29. The device of claim 19, wherein said smooth surface extends across substantially the entire width of the web carried on said drying wire.

30. The device of claim 20, wherein said smooth surface extends across substantially the entire width of the web carried on said drying wire.

* * * * *